US007959696B2

(12) United States Patent
Martic et al.

(10) Patent No.: US 7,959,696 B2
(45) Date of Patent: Jun. 14, 2011

(54) KITCHEN EXTRACTOR HOOD WITH INNOVATIVE DESIGN

(76) Inventors: Veljko Martic, Jesi (IT); Nebojsa Zecevic, Jesi (IT)

( * ) Notice: Subject to any disclaimer, the term of this patent is extended or adjusted under 35 U.S.C. 154(b) by 0 days.

(21) Appl. No.: 12/451,636

(22) PCT Filed: May 30, 2008

(86) PCT No.: PCT/EP2008/056690

§ 371 (c)(1),
(2), (4) Date: Nov. 23, 2009

(87) PCT Pub. No.: WO2008/148712

PCT Pub. Date: Dec. 11, 2008

(65) Prior Publication Data

US 2010/0126123 A1 May 27, 2010

(30) Foreign Application Priority Data

Jun. 6, 2007 (IT) ..... MC2007A0118

(51) Int. Cl.
*B01D 45/00* (2006.01)

(52) U.S. Cl. ..... 55/344; 55/DIG. 36; 55/DIG. 29; 55/465; 55/463; 55/438; 55/462; 55/385.1; 55/385.2; 55/418; 55/410; 55/413; 55/414; 454/188; 454/191; 126/299 R; 126/299 F; 126/300

(58) Field of Classification Search ..... 55/344, 55/DIG. 36, DIG. 29, 465, 463, 438, 462, 55/385.1, 385.2, 418, 410, 413, 414; 454/188, 191; 126/299 R–299 F, 300
See application file for complete search history.

(56) References Cited

U.S. PATENT DOCUMENTS

| | | | | | |
|---|---|---|---|---|---|
| 2,210,458 | A | * | 8/1940 | Keilholtz | 454/233 |
| 3,397,631 | A | * | 8/1968 | Simons | 454/190 |
| 3,800,689 | A | * | 4/1974 | Brown | 126/299 D |
| 4,043,319 | A | * | 8/1977 | Jensen | 126/299 D |
| 4,186,727 | A | * | 2/1980 | Kaufman et al. | 126/299 D |
| 4,211,155 | A | * | 7/1980 | Stoll et al. | 454/57 |
| 4,450,756 | A | * | 5/1984 | Kling | 454/67 |
| 4,475,534 | A | * | 10/1984 | Moriarty | 126/299 D |
| 4,483,316 | A | * | 11/1984 | Fritz et al. | 126/299 D |
| 5,263,897 | A | * | 11/1993 | Kondo et al. | 454/189 |
| 5,713,346 | A | * | 2/1998 | Kuechler | 126/299 D |
| 5,718,219 | A | * | 2/1998 | Boudreault | 126/299 E |

FOREIGN PATENT DOCUMENTS

DE 4114329 A1 * 11/1992

* cited by examiner

*Primary Examiner* — Jason M Greene
*Assistant Examiner* — Dung Bui

(57) ABSTRACT

The present invention relates to an extractor hood that comprises an extraction conduit and a delivery conduit, the first one housing an air treatment unit that extracts air through the lower mouth of the same conduit, and the second one housing an air treatment unit that produces a forced air flow with inside-outside direction, which is suitably conveyed by a deflector with downward inclination to generate a pneumatic screen above the cook top that conveys fumes rising from the cook top towards the lower mouth of the extraction conduit.

13 Claims, 7 Drawing Sheets

KITCHEN EXTRACTOR HOOD WITH INNOVATIVE DESIGN

The present patent application for industrial invention relates to a kitchen extractor hood with new design.

The characteristics and advantages of the invention will become more evident after a short illustration of the prior technique.

Traditional models of extractor hoods are composed of a large box-shaped body, technical defined as "shell", which houses an electrical motor that operates a fan used to extract the fumes coming from the cook top into the shell.

A tubular conduit with lower section (basically a chimney) is inserted on top of the shell to convey fumes towards a flue and eject them outside.

The shell usually has a large width, which basically corresponds to the area of the cook top, in order to intercept the fumes coming from the cook top.

In view of the above, fumes are taken inside the shell, without the need to provide the same shell with a specially powerful extraction unit.

Nevertheless, the presence of such a large shell is not appreciated in the kitchen, due to the large volume and for aesthetical reasons.

For this reason, extractor hoods without the said wide shell have been designed recently.

According to this advanced design, the extractor hood basically consists in a simple chimney inserted directly in the flue, it being provided that the chimney directly houses the forced extraction unit for the fumes.

Considering that the mouth of the chimney does not have a very large section, it appears evident that the chimney is not "naturally" able to intercept all the fumes coming from the cook top.

To overcome this functional limit, the chimney has been provided internally with a powerful extraction unit with very high extraction capacity.

Nevertheless, this involves a series of considerable inconveniences related on one side to the high cost of such a powerful extraction unit and on the other side to the high noise level produced by the extraction unit during operation.

The specific purpose of the present invention is to devise an extraction hood able to overcome the two aforementioned inconveniences of the prior technique.

The extractor hood of the invention takes inspiration from the extractor hoods without the traditional sheet metal shell, which is the most critical component in terms of aesthetics and volume.

The extractor hood of the invention consists in a simple chimney designed to house an electrically powered extraction unit.

The main peculiarity of this hood consists in its capability to convey the fumes from the cook top towards the mouth of the hood without the traditional sheet metal shell.

According to the new hood of the invention, the absence of a "physical" conveyor shell is balanced by the presence of a pneumatically operated "virtual" conveyor shell.

The efficient conveyance of the fumes allows the extractor hood of the invention to be internally provided with an extraction unit with limited power (same as the ones that are currently used inside sheet metal shells of traditional extractor hoods), with benefits in terms of cost and silent operation of the same hood.

The aforementioned inventive idea is implemented by providing two different conduits inside the structure of the new extractor hood, one of which at least housing an electrical fan unit.

The first conduit houses an electrical extraction fan unit, which is capable of extracting air, designed to be situated in such a position that the extraction mouth is situated above the cook top.

The second conduit blows air from inside outwards through the mouth of the same conduit. The air extracted by the first conduit can be blown or, alternatively, a second extraction fan unit can be used to blow air in the second conduit.

The second conduit ends with a deflector designed to impose a basically inclined direction to the forced air flow with respect to the direction of the air extracted by the first conduit.

It can be otherwise said that the forced air flow ejected from the second conduit of the extractor hood of the invention must be directed in such a way to occupy the space above the cook top.

In this way, the forced air flow is able to generate a sort of pneumatic screen with respect to the cook top below, which is able to intercept all ascending fumes.

Practically speaking, the interference of the said fumes with the pneumatic screen, in combination with the special inclination given to the said screen, creates a basically circular vortical motion that favours the conveyance of fumes towards the mouth of the extraction conduit of the hood of the invention.

It appears evident that the extraction unit housed in the second conduit does not need to have specially high power, since the extraction action must be exerted only "at short range", that is to say for the fumes that have been previously conveyed by the pneumatic screen in the mouth of the conduit that houses it.

For purposes of clarity, the description of the invention continues with reference to the enclosed drawings, which are intended for purposes of illustration only and not in a limiting sense, whereby:

Figure 1:
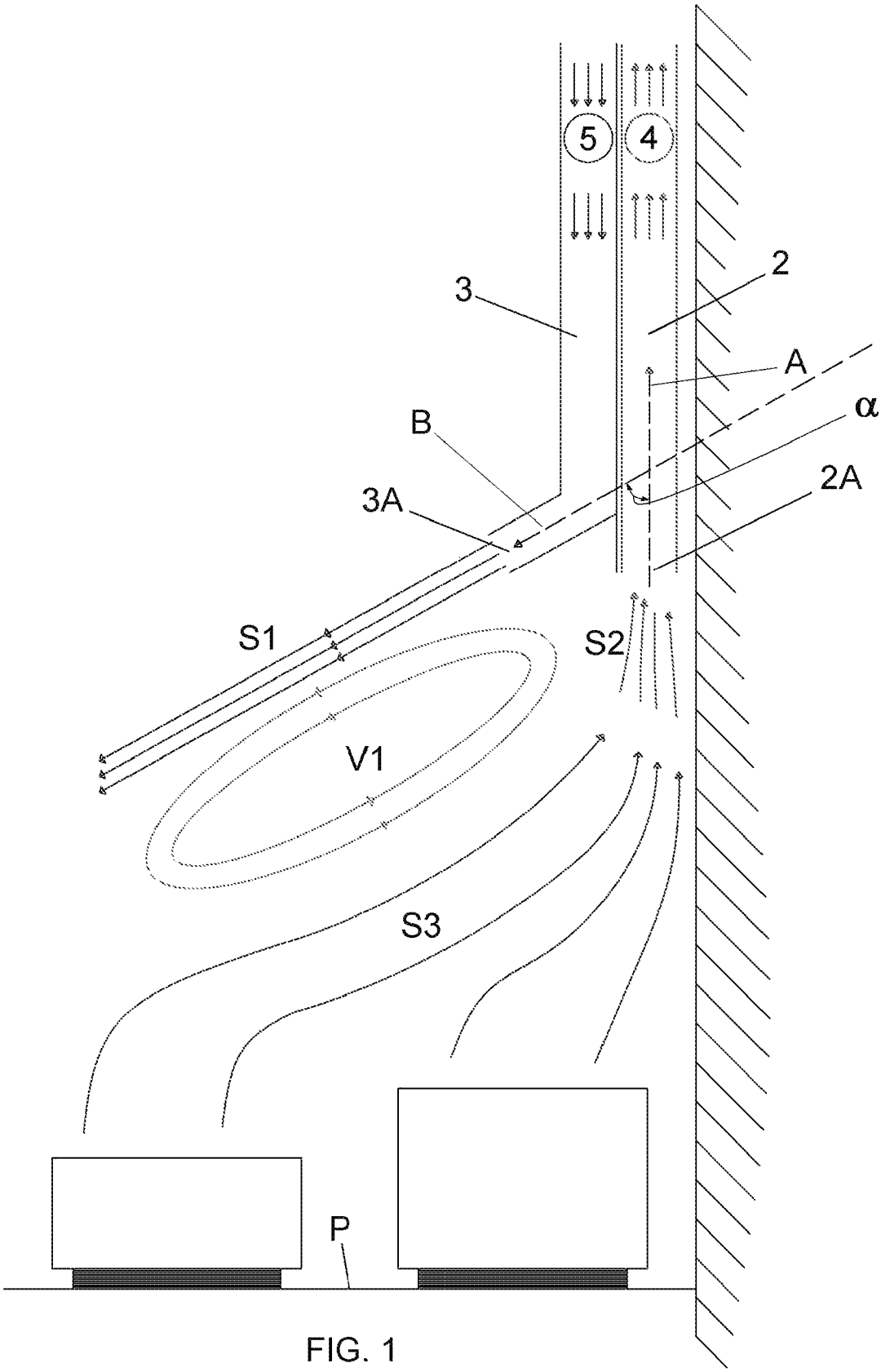
FIG. 1 is a diagrammatic view that illustrates the structure and operating principle of the extractor hood of the invention.

With reference to FIG. 1, the hood of the invention (1) has a structure comprising two vertical conduits (2, 3) in close parallel position.

The first conduit (2) designed to be positioned above the cook top (P) houses an electrically powered air treatment unit (4) used to extract a forced air flow (S2) inside the conduit (2) through the lower mouth (2A) of the said conduit (2).

The second conduit (3) houses an electrically powered air treatment unit (5) designed to generate a forced air flow that comes out from the lower end of the same conduit (3) through a deflector with downward inclination (3A) on the opposite side with respect to the first conduit (2).

As shown in FIG. 1, the conveyance action exerted by the deflector (3A) ensures that the forced air flow coming out from the conduit (3) generates a pneumatic screen (S1) with inclined direction from up down above the cook top (P).

As mentioned above, the interaction between the extraction flow (S2) and the pneumatic screen (S1) generated by the delivery flow creates a vortex (V1) that favours the conveyance of all fumes (S3) rising from the cook top (P) towards the extraction mouth (2A) of the first conduit (2).

In such a condition, fumes (S3) are easily extracted inside the conduit (2) regardless of the presence of an extraction unit (4) with limited power.

In particular, the extraction mouth (2A) extracts an air flow (S2) in the direction of axis (A). On the contrary, the delivery deflector (3A) conveys a forced air flow (S1) in the direction of axis (B).

The extraction mouth (2A) can be given any orientation in such a way that the axis (A) of the extracted air flow (S2) forms an angle from 0° to 90° with respect to a horizontal plane that basically coincides with the cook top (P). In FIG. 1, the extraction mouth (2A) is shown close to the wall, with axis (A) orthogonal to a horizontal plane. Nevertheless, the extraction mouth (2A) can be recessed into the wall in such a way that the axis (A) of the extracted air flow is, for instance, parallel to a horizontal plane.

The delivery deflector (3A) can be given any orientation with respect to the extraction mouth (2A), in such a way that between the axis (A) and the axis (B) an angle ($\alpha$) different from zero is formed. Preferably, the angle ($\alpha$) is included between 10° and 80°.

Regardless of the indications given in the aforementioned figure, some alternative embodiments of the present inventive principle can be illustrated.

The hood of the invention can be realised in wall-mounted version with a cook top installed in a cabinet positioned against the same wall, as shown in FIG. 1.

Figure 3:
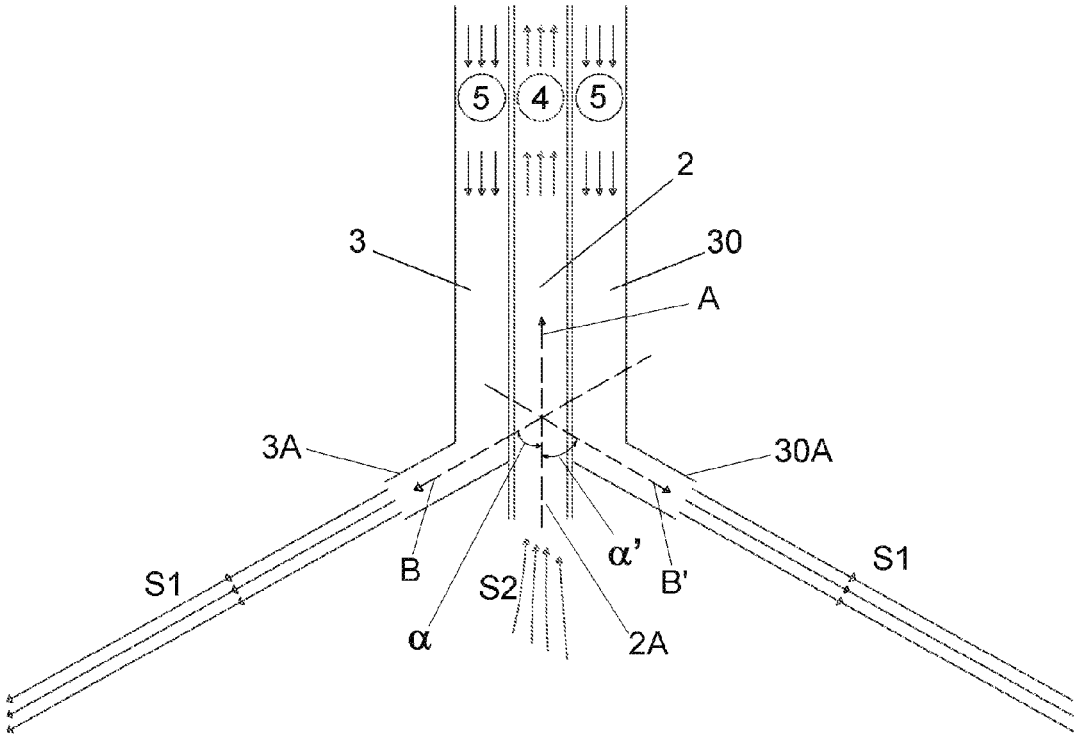
FIG. 3 is a diagrammatic view of a third constructive embodiment of the said extractor hood.
Figure 3:
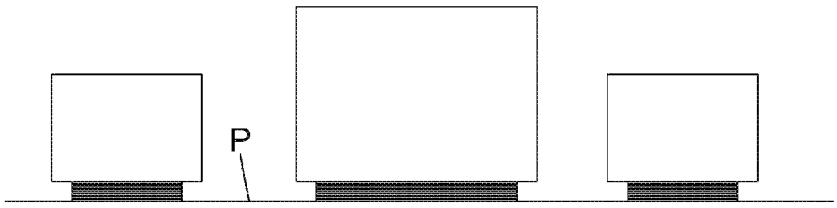

Nevertheless, the same hood can be realised in "suspended" version in the centre of a room with a cook top installed in a cabinet positioned in the centre of the room, as shown in FIG. 3.

In this second case, the first conduit (2) that houses the extraction unit (4) is positioned between two specimens (3, 30) of the delivery conduit that houses the unit (5) designed to generate the outgoing forced air flow.

In this case, the deflectors (3A, 30A) provided at the lower ends of the two specimens (3, 30) of the delivery conduit are oriented from opposite sides to create two symmetrically opposite flaps of a roof-shaped pneumatic screen (S1) above the cook top (P).

Figure 2:
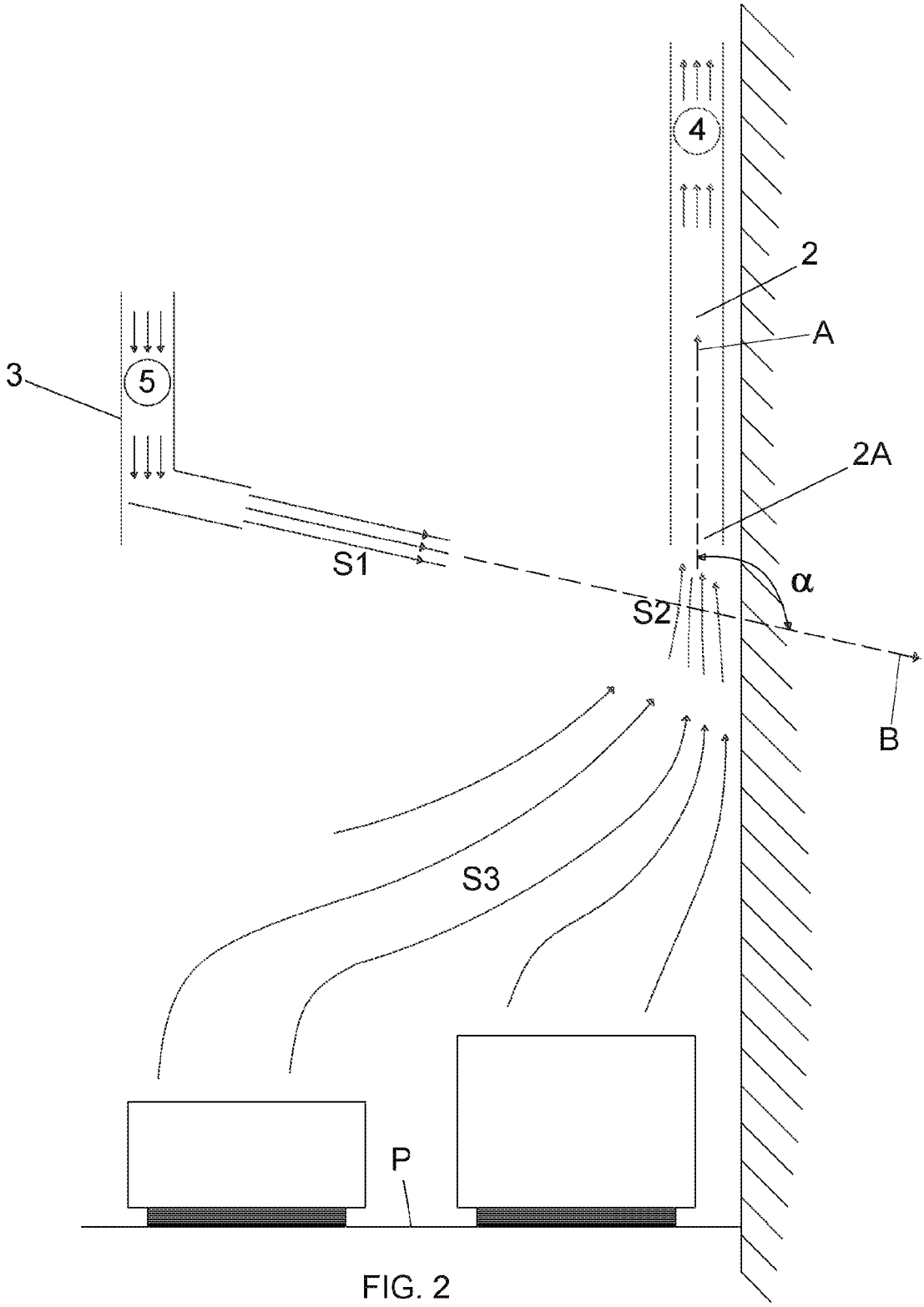
FIG. 2 is a diagrammatic view of a second constructive embodiment of the said extractor hood.

According to another constructive embodiment shown in FIG. 2, the second conduit (3) that houses the air treatment unit (5) designed to originate one or more pneumatic screens (S1) is positioned at a certain distance from the first conduit (2).

In this case the deflector provided at the lower end of the second conduit (3) is directed towards the first conduit (2) at a lower height than the height of the extraction mouth (2A) of the same conduit.

Obviously, the position and orientation given to this deflector are such that the pneumatic screen (S1) generated by it is positioned above the cook top (P), thus intercepting all fumes (S3) rising from the cook top.

According to the present inventive idea, an alternative solution may be provided also for the two air treatment units (4, 5) respectively housed in the extraction conduit (2) and in the delivery conduit (3).

According to a first hypothesis, two electrical fan units are provided, one for extraction and one for delivery. Alternatively, a single motor unit with two contra-rotating fans can be provided, one for operation inside the extraction conduit (2) and one for operation inside the delivery conduit (3).

Another alternative consists in using only one fan (4) both for extraction and delivery. In this case, the extraction conduit (2) is connected to the delivery conduit (3). Consequently, part of the air extracted from the fan (4) is forced into the delivery conduit (3) in order to be used to generate the pneumatic screen (S1).

Moreover, the second conduit (3) can be provided at the end, in addition to the deflector (3*a*), with one or more additional deflectors designed to create corresponding pneumatic screens above the cook top with intersecting directions, in order to shape and dimension the efficacy area of the multiple cooperating pneumatic screens as desired.

Finally, it must be noted that the two conduits (2, 3) of the various embodiments of the extractor hood of the invention (1) may be also provided with non-vertical development (other than the hood shown in the aforementioned figures), since the only condition necessary to operate the hood (1) is that the mouth (2A) of the extraction conduit (2) is positioned above the cook top (P) and the deflector or deflectors (3A) of the delivery conduit (3) give the pneumatic screens (S1) generated by them an inclined position with angle ($\alpha$) different from zero with respect to the axis (A) of the extracted air flow (S2).

Figure 4:
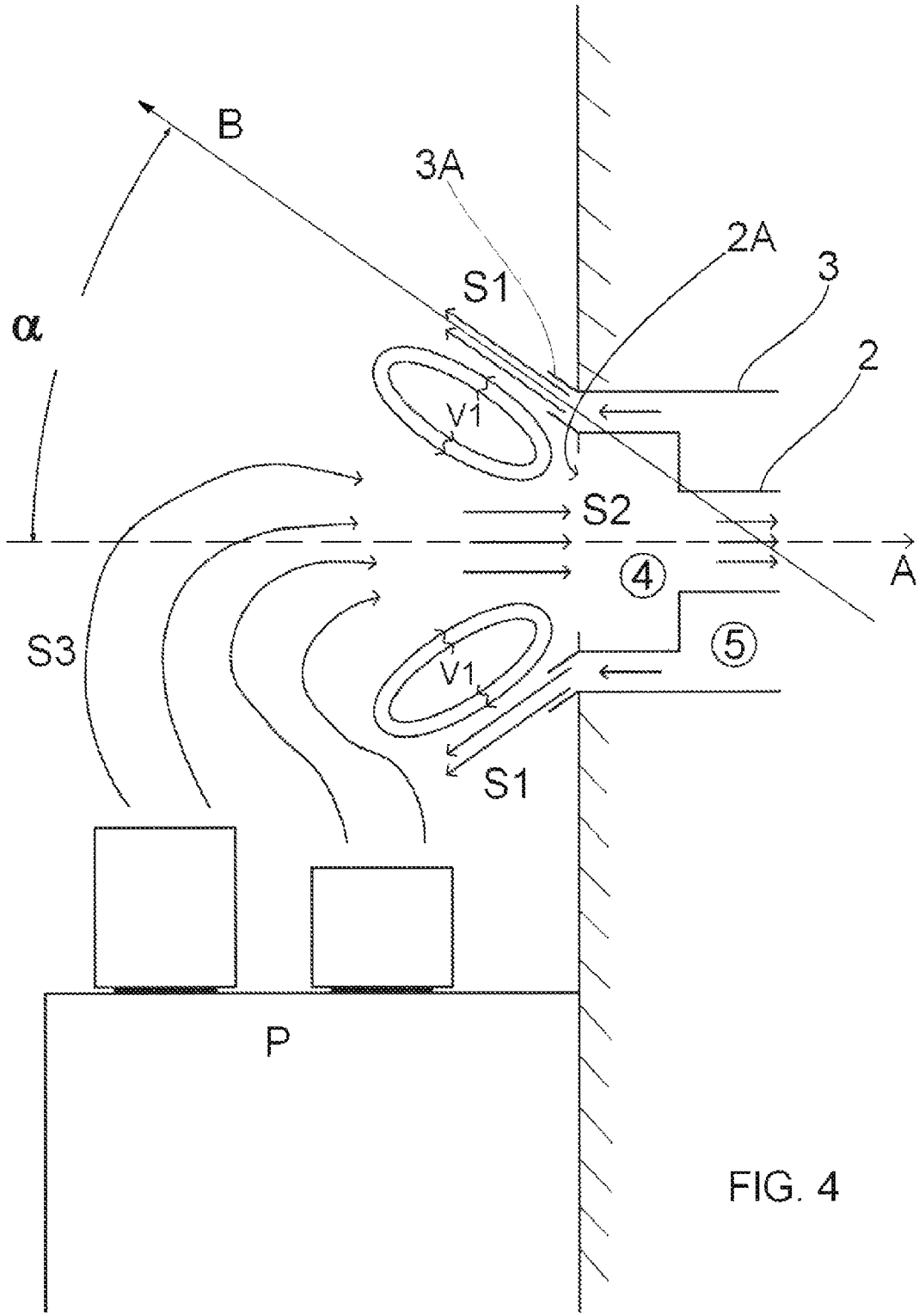
FIG. 4 is a diagrammatic view of a fourth constructive embodiment of the said extractor hood.

FIG. 4 illustrates a fourth embodiment of the present invention, whereby the extraction and delivery conduits (2, 3) are in coaxial position, one inside the other, and recessed in a vertical wall. Therefore, the axis (A) of the extracted air flow is parallel to a horizontal plane. In this case, the delivery deflector (3A) has a truncated-conical shape in order to generate a conical flow (S1) arranged as a shell around the extracted air flow (S2). The conical flow (S1) has a conicity angle ($\alpha$) with respect to its axis that coincides with the axis (A) of the extracted air flow (S2).

Figure 5:
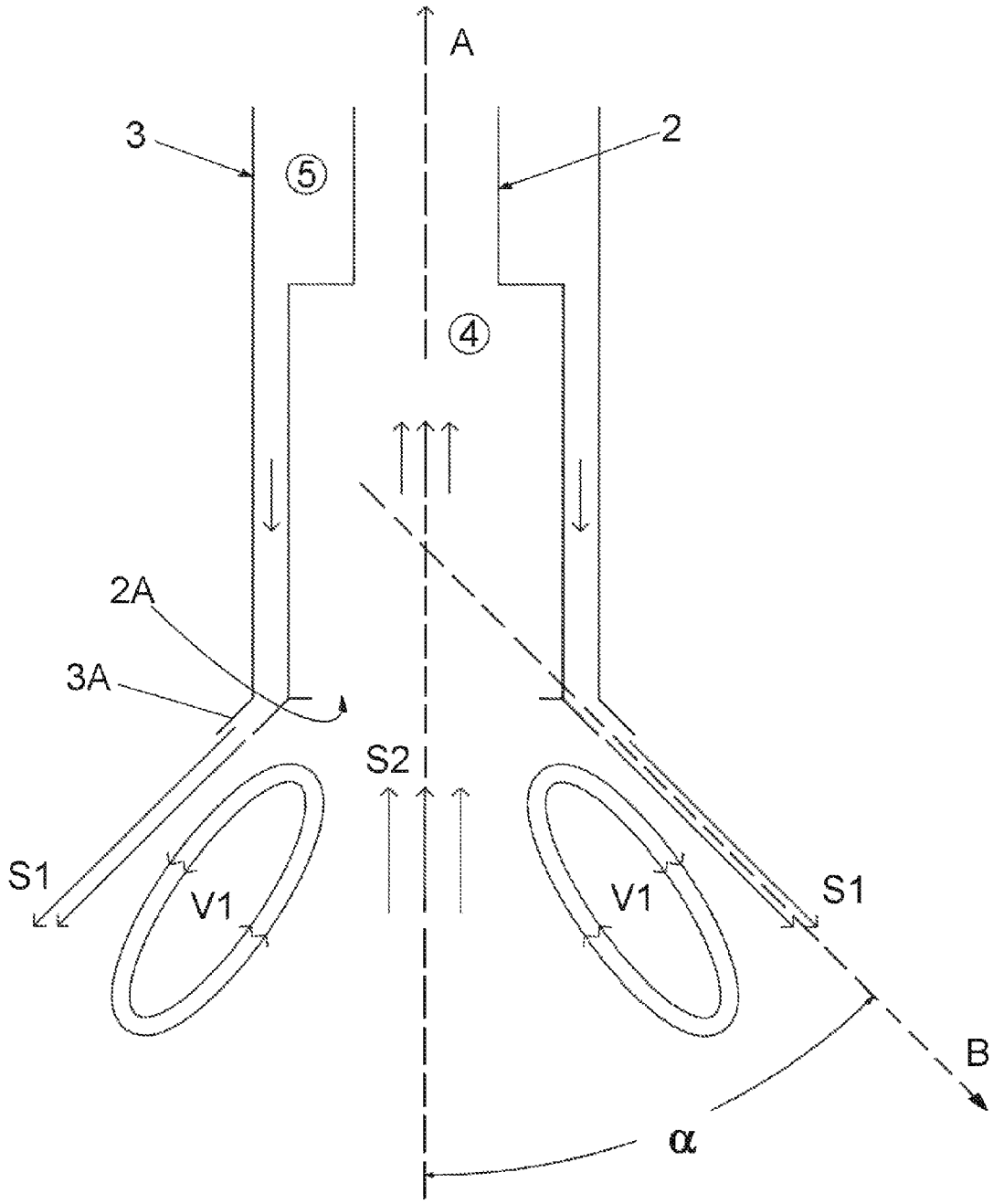
FIG. 5 is a diagrammatic view of a fifth constructive embodiment of the said extractor hood.

FIG. 5 illustrates a variant of the embodiment shown in FIG. 4, whereby the axis (A) of the extracted air flow is orthogonal to a horizontal plane. This solution is appropriate when the cook top is positioned in the centre of the room and the extractor hood must be connected to the ceiling.

Figure 6:
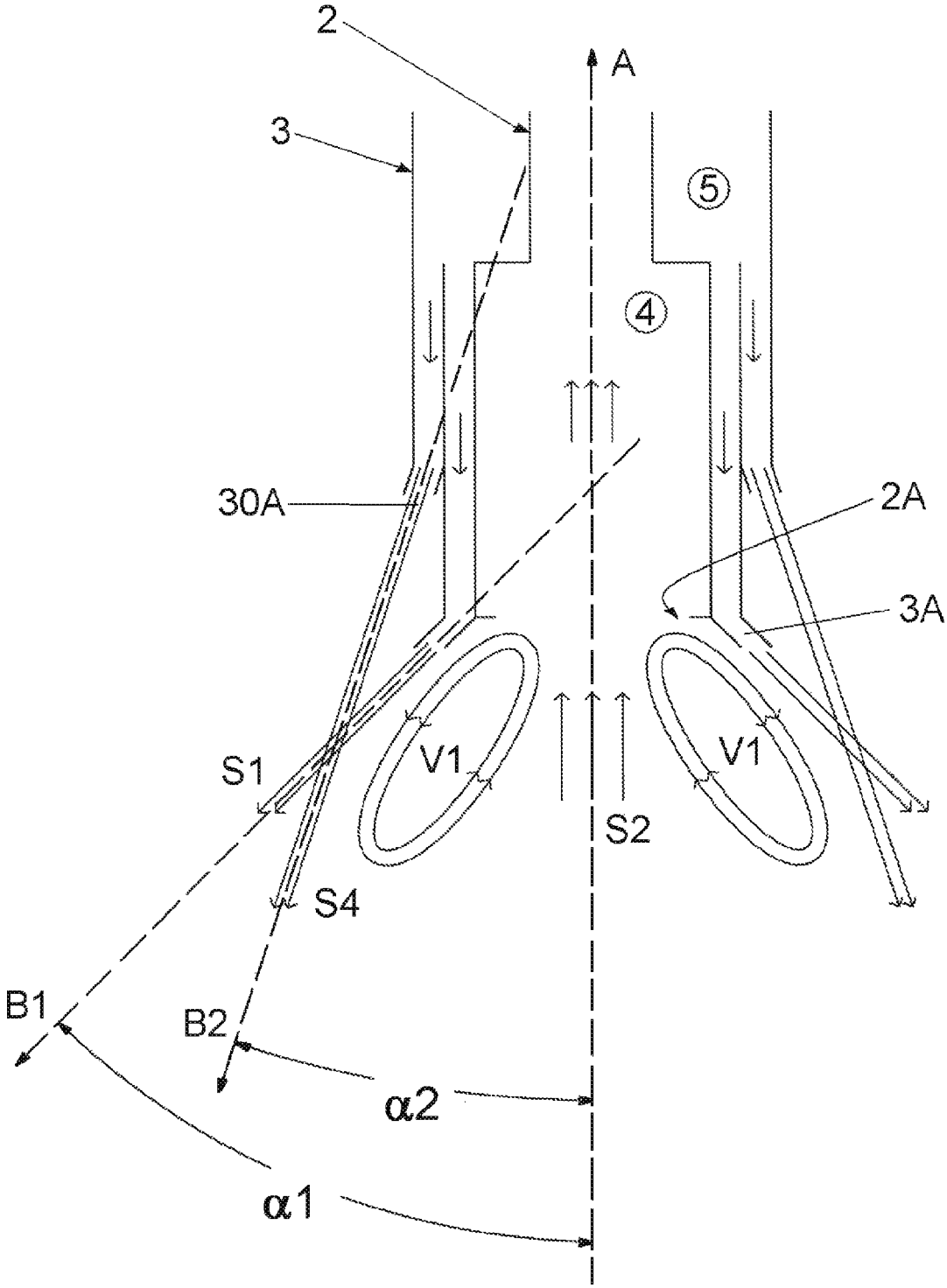
FIG. 6 is a diagrammatic view of a variant of the fifth constructive embodiment of the said extractor hood.

FIG. 6 illustrates a fifth embodiment of the invention, whereby the delivery conduit (3) is in coaxial position on the extraction conduit (2). The delivery conduit (3) is divided into parts by two truncated-conical deflectors (3A, 30A) that generate corresponding intersecting conical flows (S1, S4). In this case, the conicity angle ($\alpha$1) of the first deflector (3A) is higher than the conicity angle ($\alpha$2) of the second deflector in order to intersect the two conical delivery flows (S1, S2).

Figure 8:
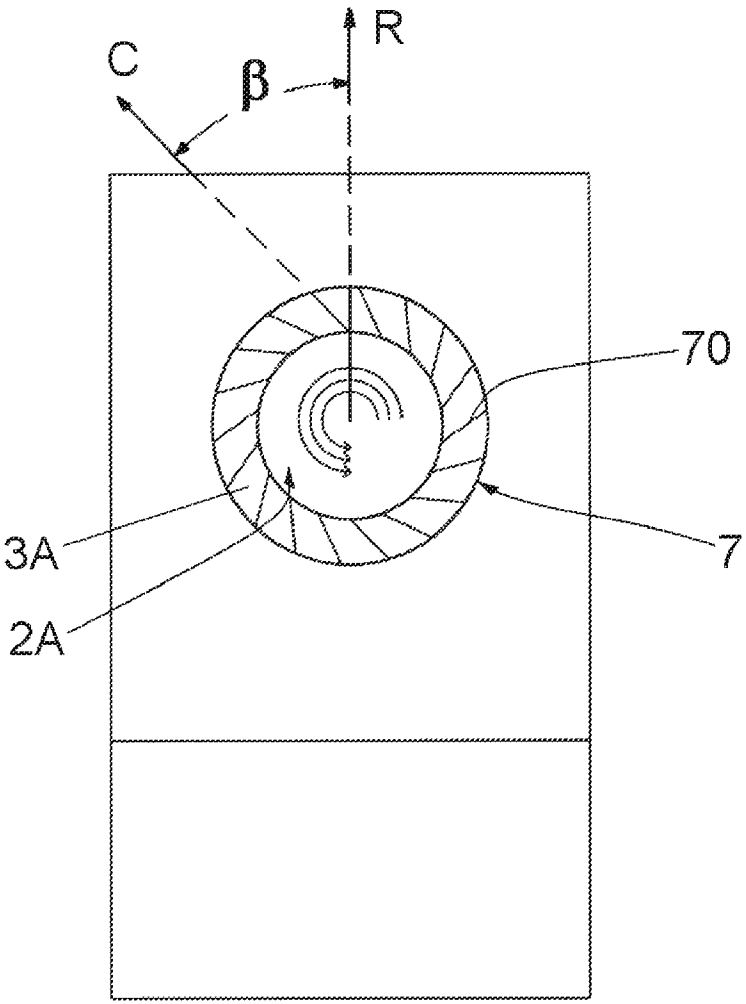
FIG. 8 is a front view of the extractor hood of FIG. 7.
Figure 7:
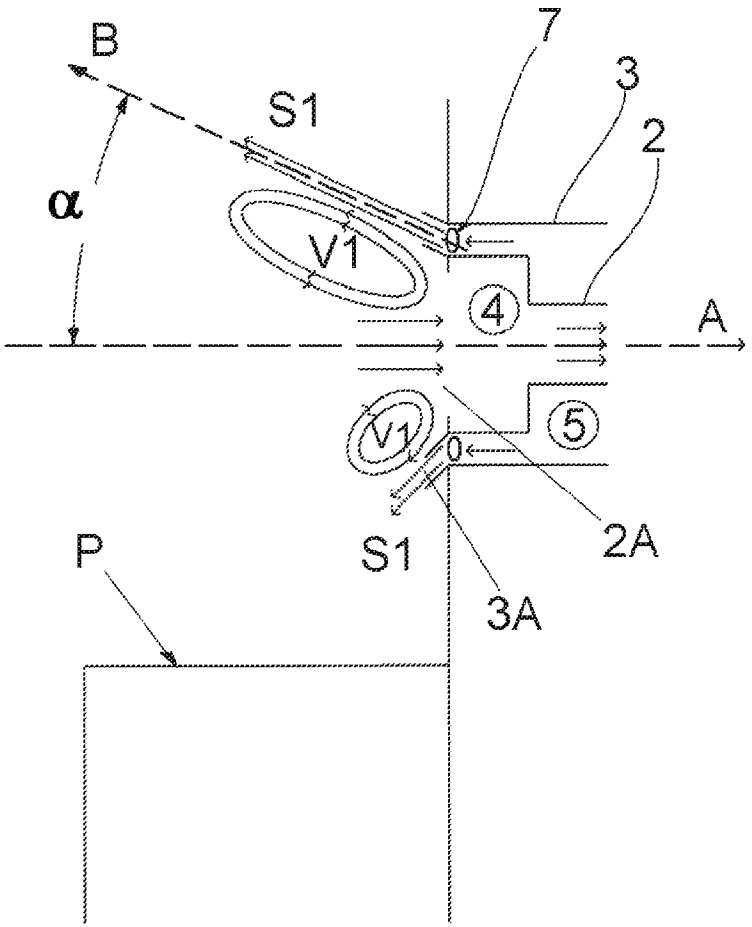
FIG. 7 is a diagrammatic view of a sixth constructive embodiment of the said extractor hood.

FIGS. 7 and 8 illustrate a sixth embodiment of the invention, whereby the delivery conduit (3) is in coaxial position on the extraction conduit (2) and the deflector (3A) has a truncated-conical shape. In this case, a distributor (7) with a plurality of blades (70) arranged according to an axis (C) inclined by an angle ($\beta$) different from zero, with respect to the radial axis (R) passing through the blade and the centre of the distributor, is mounted in the deflector (3A). In this way the distributor (7) generates a pneumatic screen (S1) with helicoidal section. In the specific example illustrated in the figure, the pneumatic screen (S1) has the section of a conical helix, although it can also be given the section of a cylindrical helix. Preferably, the angle ($\beta$) of the distributor blades ranges from 10° to 80°.

The invention claimed is:

1. Extractor hood comprising:

an extraction conduit (2) with extraction mouth (2A) used to extract an air flow (S2) in the direction of an axis (A) in such a way to extract the fumes (S3) from the cook top (P), an air treatment unit (4) designed to force air through the extraction conduit (2), at least one delivery conduit (3; 30) provided with at least one deflector (3A; 30A) designed to convey a forced air flow (S1; S4) outside in the direction of at least one axis (B; B'; B1, B2) that forms an angle (α; α'; α1; α2) different from zero with respect to the axis (A) of the extracted air flow (S2), in such a way to generate a pneumatic screen (S1, S4) and a vortex (V1) between the extracted air flow (S2) and the pneumatic screen (S1, S4) that favours air extraction through the mouth (2A), wherein the deflectors (3A, 30A) of the same specimen of the delivery conduit (3, 30) are directed in such a way to generate corresponding pneumatic screens with intersecting directions above the cook top (P), wherein the extraction conduit (2) is mounted in coaxial position in the delivery conduit (3), wherein a distributor (7) is mounted inside the delivery deflector (3A), being provided with a plurality of blades (70) arranged according to an axis (C) inclined by an angle β different from zero, with respect to the radial axis (R) passing through the blade in order to generate a pneumatic screen (S1) with helicoidal section.

2. Extractor hood as claimed in claim 1, wherein the axis (A) of the extracted air flow (S2) forms an angle from 0° to 90° with respect to a horizontal plane.

3. Extractor hood as claimed in claim 1, wherein the angle (α; α'; α1; α2) between the axis (A) of the extracted air flow (S2) of the axis of the pneumatic screen (S1, S4) ranges from 10° to 80°.

4. Extractor hood as claimed in claim 1, wherein it comprises one air treatment unit (4) only and the extraction conduit (2) is connected to the delivery conduit (3) in order to circulate part of the air (S2) extracted by the air treatment until (4) and generate a forced air flow (S1; S4) in the delivery conduit (3) to be conveyed outside.

5. Extractor hood as claimed in claim 1, wherein the two conduits (2, 3) are mounted in close position.

6. Extractor hood as claimed in claim 1, wherein the delivery deflector (3A) has a truncated-conical shape in order to generate a conical pneumatic screen (S1) that surrounds the extracted air flow (S2) as a shell.

7. Extractor hood as claimed in claim 1, wherein the angle (β) of the blades (70) of the distributor ranges from 10° to 80°.

8. Extractor hood as claimed in claim 1, wherein the extractor hood has a suitable structure for wall installation.

9. Extractor hood as claimed in claim 1, wherein the extraction conduit (2) and the delivery conduit (3, 30) have a horizontal development and are recessed into the wall.

10. Extractor hood as claimed in claim 1, wherein the extraction conduit (2) houses an air treatment unit (4) designed to force the air through a lower mouth (2A) of the same conduit (2), while the delivery conduit (3) houses an air treatment unit (5) designed to produce a forced air flow with inside-outside direction, which is suitably conveyed by one or more deflectors with downward orientation (3A) provided in a lower mouth of the delivery conduit (3) to generate corresponding pneumatic screens (S1) above the cook top (P).

11. Extractor hood as claimed in claim 10, wherein the two air treatment units (4, 5), respectively housed in the extraction conduit (2) and in the delivery conduit (3), consist in two fans operated by corresponding electrical motors.

12. Extractor hood as claimed in claim 10, wherein the two air treatment units (4, 5), respectively housed in the extraction conduit (2) and in the delivery conduit (3), consist in two counter rotating fans operated by a single electrical motor.

13. Extractor hood as claimed in claim 10, wherein the extraction conduit (2) and the delivery conduit (3, 30) have a vertical development.

* * * * *